United States Patent [19]

Krumm

[11] 4,445,544

[45] May 1, 1984

[54] LENO-SELVAGE FORMING DEVICE

[75] Inventor: Valentin Krumm, Hergensweiler, Fed. Rep. of Germany

[73] Assignee: Lindauer Dornier Gesellschaft mbH, Fed. Rep. of Germany

[21] Appl. No.: 348,686

[22] Filed: Feb. 16, 1982

[51] Int. Cl.[3] ..... D03C 7/00

[52] U.S. Cl. ..... 139/54

[58] Field of Search ..... 139/54, 91, 92

[56] References Cited

U.S. PATENT DOCUMENTS

| | | | |
|---|---|---|---|
| 3,227,191 | 1/1966 | Juillard | 139/54 |
| 3,349,810 | 10/1967 | Goodmann | 139/92 |
| 3,795,261 | 3/1974 | Serturini | 139/54 |
| 3,837,365 | 9/1974 | Filter | 139/92 |

FOREIGN PATENT DOCUMENTS

| | | | |
|---|---|---|---|
| 1147539 | 4/1963 | Fed. Rep. of Germany | 139/92 |
| 1162468 | 4/1958 | France | 139/92 |

*Primary Examiner*—Henry Jaudon

*Attorney, Agent, or Firm*—James E. Bryan

[57] ABSTRACT

The invention relates to the fastening of a leno device in shuttleless weaving machines. Leno devices generally are composed of two parts one behind the other, designed in the manner of rails and being mutually displaceable in the longitudinal direction for the purpose of shed-formation and are fastened to two consecutive heddle frames or the heddle slide bars thereof. To facilitate the fastening of the tightly arranged parts, only the upper fastening means on the forward part, that is the leno body supporting the standard thread needles is designed as an immobile fastener, whereas the remaining fastening points of the leno device are designed as quick-fit devices allowing a limited displacement along the heddle slide bars. The most diverse types of quick-fit means such as plug-in or spring-clip connectors, spring-hooks, clamping or snap-in connectors can be used.

8 Claims, 5 Drawing Figures

LENO-SELVAGE FORMING DEVICE

Figure 1:
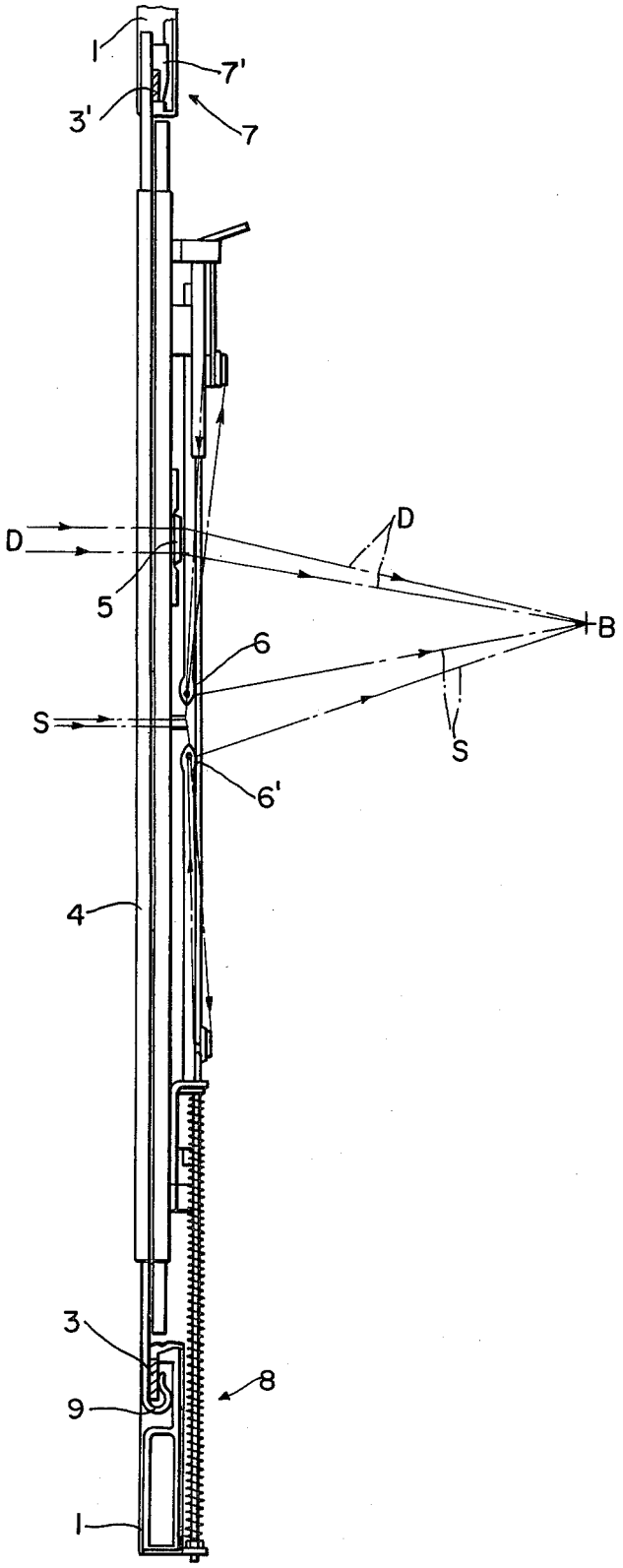

The invention relates to a device for forming leno-selvages on fabrics made on shuttleless weaving machines.

In fabrics made on shuttleless weaving machines, the cut off filling ends ordinarily are positioned opposite one another in a frayed manner. To prevent the fabric from fraying, special devices are required and are known, which form a bound edge at the selvage. On one hand, the devices for bending over and inserting the projecting weft yarn end into the next shed for the formation of a so-called tucked-in selvage are cited, and on the other hand, the leno devices which additionally use leno threads and standard threads to form the selvages. The invention relates to the devices of the last cited type, in particular those using a cross leno interlacing.

In leno devices, the leno threads and standard threads extend in the direction of the warp yarns and are used during the weaving process together with the warp yarns to form the weaving shed. The parts of the leno device therefore are mounted to the heddle frames and participate in the up and down motions thereof. Such a leno device is known for instance from German Auslegeschrift No. 2,605,489. The leno devices contain at least one pair of needles coaxially mounted on a leno body or a rail and extending parallel to the regular weaving heddles and including eyelets maintained a close distance apart at their opposite tips to pass the standard threads through. One pair of leno threads is provided for each pair of needles. The leno threads are pulled through a control means with thread guidance in such a manner that one leno thread of one pair is positioned on both sides of a standard thread needle. The control means for the leno threads, together with its yarn guide means, is displaceable parallel to the standard thread needles, the guidance for the two leno threads being such that the position of the leno threads is interchanged when passing from one to the other standard thread needle. A rotating cam with two feed-throughs for the yarns can be used as the control means with yarn guidance, for example. When displacing the cam with simultaneous rotation, an interchange of the positions of the leno threads with respect to the standard thread needles is obtained.

Another device for interchanging the yarn position is disclosed in German Auslegeschrift No. 1,535,328. Therein two sequentially located and mutually displaceable slide blocks each with one pair of oblique thread guide slots are provided. The associated guide slots of the two slide blocks are positioned mutually opposite and arranged crosswise. The leno threads are passed through the slide blocks and, due to their crosswise arrangements, interchange the thread array during the relative displacement.

The arrangement of the control means for the leno threads, thus for instance the arrangement of the slide blocks with the oblique guide slots or of the rotatable cam with its feed-throughs, also may be different. Thus an arrangement is known in practice, using a separate bracket means, whereas in the above-cited German Auslegeschrift No. 2,605,489, the cam is mounted in its function of control on a rail-like support which also holds the standard thread needles. The support in turn is mounted on a heddle frame. A tension means controls the relative motion of the cam and the rotation thereof. In other leno devices, for instance as regards the slide block controls also mentioned above, the standard thread needles together with one of the slide blocks are mounted on a rail-like needle support and the second slide block is correspondingly mounted in a displaceable manner in a corresponding second rail positioned therebehind. The two rails are fixed to two heddle frames located therebehind. Thus, in one case the entire leno device requires two fastening points at one heddle frame or in the other case a total of four fastening points at two heddle frames. Practically, the fastening points are positioned either at the frame of the heddle or most frequently at the heddle slide bars.

Because little space is available at the heddle frames, the leno device also has little accessibility when being installed or when being rearranged after installation. Thus, the fixing in place of the leno device is laborious and complex, and this is a particular drawback when, as is most often the case, there are four fastening points of which two are so arranged one behind the other that the rearmost is covered by the foremost. Ordinarily, the parts of the leno device are fixed to the heddle slide bars by screw-clamping connectors. If there is a two-part leno device with four fastening points, then for instance the forward part, which is the leno body bearing the needles, must be hooked into the upper heddle slide bar by means of a stop or a beak and then be preliminarily screwed on by a threaded compression piece. The second rail-like part of the leno device with the second slide block must be correspondingly hooked in and secured tight to the upper heddle slide bar of the neighboring heddle frame. The two parts are similarly fastened by their lower ends to the lower heddle slide bars of the two heddle frames using compression pieces. Only when the second part of the leno device has been fixed is it possible to again loosen the first part in front of it, which then is moved into its precise position where it is finally secured in position.

This awkward handling of the leno device in the narrow space at the heddles entails that in practice one fourth of the change-over time of a weaving machine, that is one hour, is devoted solely to the leno device. This represents a significant drawback.

It is therefore the object of the present invention to simplify the fastening of leno devices to the heddle slide bars in such a manner that the leno device can be mounted to or changed-over with adequate reliability and in a substantially shorter time at the heddle slide bars.

This problem is solved by the present invention for a leno device for shuttleless weaving machines comprising a rail-like leno body mounted to upper and lower heddle slide bars and acting as a support means for pairwise arranged, mutually opposite needles provided with eyelets for pairwise fed standard threads. The leno device further includes a control means displaceable parallel to the needles and having guide slots for pairwise fed leno threads. In the improvement of the present invention, the upper rail end of the leno body is provided with a fastening part fixing the position of the device on the heddle slide bar and the remaining ends of the device are secured to the heddle slide bars by quick-fit fastening parts which allow a displacement along the heddle slide bars. It is essential therefore that only the upper fastening means of the main piece, that is the needle support, be immovably secured to the upper heddle slide bar at the two, or in practice at the usually four fastening points, for instance in the form of a non-slip clamping connection, whereas the remaining fastening points, regardless of being positioned at the lower heddle slide bar of the same heddle frame or at the upper and lower heddle slide bars of the neighboring heddle frame, can be designed as simple and quick-fit or disconnect means which do not require difficult, awkward and time-consuming steps. In the form of quick-fit means, the most varied designs can be utilized singly or in combination, for instance plug-in, clamping or spring-clip connectors, hooks, lashes, tightening or snap-in connectors, and the like. The portion of the change-over time of weaving machine presently devoted to the leno device, in this manner can be reduced to a small fraction of the time previously required because awkward handling and adjustment at the fastening points is eliminated. Fine-control, precise positioning and final securing of the main piece no longer are required.

The invention is applicable to the most diverse leno devices. For instance, it can be used just as well with leno devices with rail-like parts associated with two neighboring heddle frames as with single-rail designs where the rail must be fastened to one heddle frame. Again, the number of pairs of neddles, or the number of pairs of leno and standard threads does not affect the applicability of the invention. Another advantage is that it applies to leno devices the neddles of which are mounted to asymmetric heddles for the purpose of adaptation, because in a further feature of the invention, the required adaptation of the control body in the second part of the leno device can be implemented by mounting known elastic transmission elements, for instance rubber cords or springs, not in fixed manner to the fastening members, but stepwise adjustably along their length. Therefore it is no longer necessary in the case of a leno device change-over to asymmetric heddles to maintain a supply of rubber cords of various lengths which, as needed, will be exchanged at the leno device, but rather a simple manual adjusting action suffices. The basic principle of the invention always applies, namely an immobile fastening of the needle support of the leno device at its upper end and a quickly implemented fastening at least displaceable to some extent and also on the heddle slide bar of the remaining parts of the leno device.

Figure 2:
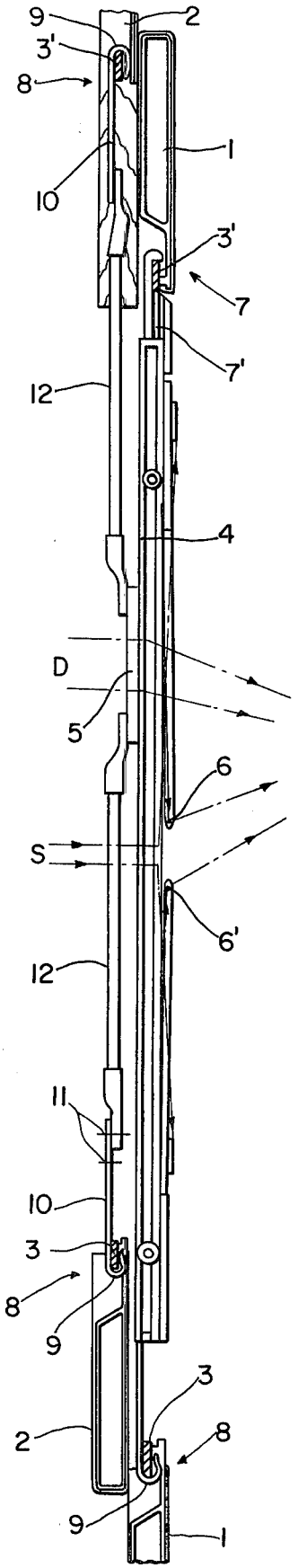
Figure 3A:
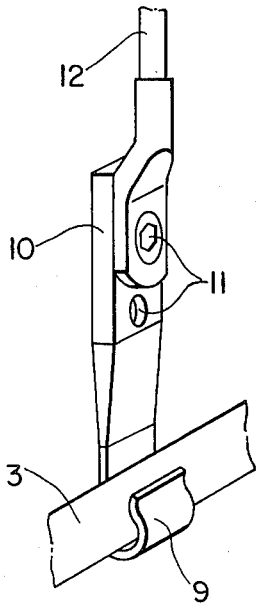
Figure 3B:
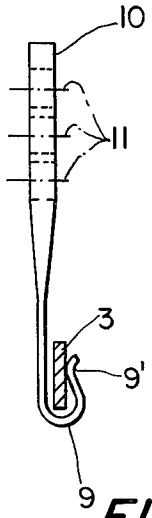
Figure 4A:
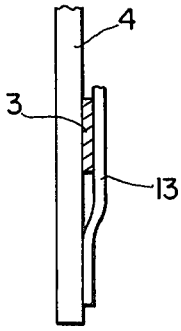
Figure 4B:
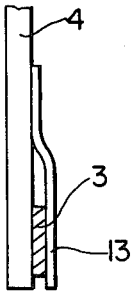
Figure 4C:
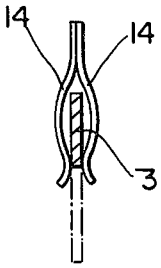
Figure 5A:
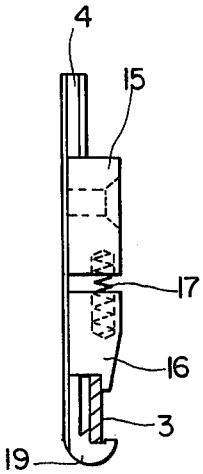
Figure 5B:
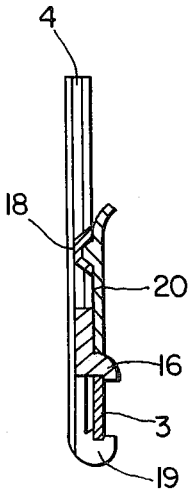

The invention will be further illustrated by reference to the accompanying drawings, in which:

FIG. 1 shows a leno device with a single rail and with fastening to the heddle slide bars, FIG. 2 shows a leno device with two rails and fastening to the heddle slide bars of two heddle frames placed one behind the other, FIGS. 3*a* and 3*b* show a way of fastening the lower rail end of a leno device, as seen obliquely or in section, FIGS. 4*a* through 4*c* show several ways for plug-in connections, and FIGS. 5*a* and 5*b* show ways of fastening using a displaceable compression piece.

Based on the above-cited German Auslegeschrift No. 2,605,489, FIG. 1 is a simplified leno device, as viewed from the side. This leno device comprises only a single rail-like leno body 4 acting as a support for a pair of standard thread needles 6, 6'. The standard thread needles are directed towards each other at their tips where they include eyelets to guide the standard threads S. The standard threads are indicated by dash-dot lines. They extend essentially in the warp direction to the interlacing point B. In a manner not described in further detail, a control body 5 is mounted in a longitudinally displaceable and rotational manner on the rail-like leno body 4. This control body 5 includes feed-through apertures for a pair of leno threads D indicated by dash-dot lines. It is apparent from the course of the leno threads D and the standard threads S to the interlacing point B, that the leno and standard threads form part of the weaving shed.

The fastening of the leno device to the heddle frame now will be described. The heddle frame is denoted by 1. The heddle frame is shown in section and is partially cut-out. A lower heddle slide bar 3 and an upper heddle slide bar 3' are positioned at the heddle frame 1. The leno device is mounted to these two heddle slide bars, namely to the upper heddle slide bar 3' by an immobile fastening means 7, for instance a claw 7', and secured there. A quick-fit means, for instance a spring hook 9 is connected as the selected connection means 8 at the lower heddle slide bar 3.

FIG. 3 shows a leno device mounted to two heddle frames 1 and 2. In this case also parts of the frames 1 and 2 are cut-out. The upper and lower heddle slide bars again are denoted by 3 and 3'. The leno device essentially is composed of a rail-like leno body 4 supporting the needles 6 and 6'.

A longitudinally displaceable control means 5 for the leno threads D also is provided. The paths of the leno threads D and standard threads S are similar to those shown in FIG. 1. The displaceability of the control body 5 is positively controlled in this case by the heddle frame 2 on account of its up-and-down motion. To that end the control means 5 or part of it is connected by an elastic transmission means 12 with the two heddle slide bars 3 and 3' of the heddle frame 2. For simplicity, a special guide rail for the components of the control means 5 has been omitted. Illustratively, the rubber bands or rubber cords 12 have been assumed as the elastic transmission means.

The fastening of the leno device is this embodiment is at four fastening points, namely in such a manner that the upper end of the leno device 4, that is of the needle support, is conventionally fastened by an immobile fastener 7 to the upper heddle slide bar 3' of the heddle 1. For this purpose, a displaceable compression piece 7" that is tightened in place is provided. The lower end of the needle support 4 is connected by a quick-fit means 8 to the lower heddle slide bar 3 of the heddle frame 1, for instance it is hooked up by means of a hook elastically yielding in the longitudinal direction of the rail-like needle support 4. The other fastening points of the leno device, at the lower and upper heddle slide bars 3 and 3' respectively, also are quick-fit means 8 and in this instance are shown in the form of the fasteners 10 with the hooks 9. The fasteners 10 are connected by the elastic transmission means 12 to the control means 5. Horizontal bars 11 at the fasteners 10 indicate that the transmission means 12 can be mounted in a stepwise displaceable manner on the fastener 10.

This embodiment makes it especially plain how substantially simplified the handling of the leno device is because of use of the quick-fit means 8. Once the immobile fastener 7 between the rail-like leno body 4 and the upper heddle slide bar 3' has been connected, there no longer will be a need to loosen this fastening, nor for the leno body to be displaced and then moved back into the precise position before a final fastening can be effected, rather it suffices to effect the remaining fastening points of the leno device to merely hook them in, or to plug them in, with a slight subsequent displacement into the final position.

From the many possible quick-fit means which are applicable, only a few will be considered and described.

FIGS. 3*a* and 3*b* show, on a somewhat larger scale, a cut-out of the left bottom part of FIG. 2. A fastener 10 terminates in a hook 9 enclosing the heddle slide bar 3. The hook end 9' elastically rests against the side of the heddle slide bar 3. This design allows not only easy hooking-in, but also a displacement along the heddle slide bar 3, while nevertheless ensuring adequate reliability against an undesired displacement during operation on account of the spring clip at the hook end 9'. This type of fastener is suitable for the most diverse profiles of the heddle slide bars. Only a rubber band 12 is indicated as the elastic transmission means. The connection of the transmission means to the fastener 10 can be adjusted stepwise and hence is easily adaptable to the requirements of asymmetric harnesses. In lieu of the rubber bands 12, it is also possible to use other parts which are elastic or spring-like in the longitudinal direction and which tension toward the heddle slide bars 3 or 3' while permitting some displacement along the heddle slide bar,that is, which after a mere plug-in or hook-in of the quick-fit means at the heddle slide bar can be conveniently displaced to the side and be moved into the precise operational position behind the part mounted in an immobile manner on the front heddle frame.

FIGS. 4*a* and 4*b* indicate the rail-like end of a leno body 4, provided with spring-tongues 13, and are plugged from above or below into the lower heddle slide bar 3', and are kept in place by the spring 13. Two symmetrically arranged spring-tongues 14 are the quick-fit means in FIG. 4*c*; these are moved over the heddle slide bar 3 and show a snap effect when in the end positions thereof. This type of fastener also can be advantageously used for all the kinds of profiles of the heddle slide bars.

FIGS. 5*a* and 5*b* show a quick-fit means which includes a beak 19 at the rail-like end of the leno body 4. This beak 19 may include a groove-shaped recess and acts as a seat for the heddle slide bar 3. A compression piece 16 is mounted in a longitudinally displaceable manner on the leno body 4 for the purpose of clamping the heddle slide bar 3 on the beak 19.

In FIG. 5*a* the compression piece 16 rests by means of a spring 17 on a block 15 mounted to the leno body 4. In this case, the compression piece therefore acts automatically. FIG. 5*b* shows a version wherein the compression piece 16 can be manually displaced along the leno body 4 and clamps the heddle slide bar 3 against the beak 19. In this instance the compression piece 16 is provided with a spring-lash 20 engaging a detent 18 and securing the compression piece against unintentional detachment. Adaptation to various dimensions or profiles of the heddle slide bars may be achieved in this latter embodiment by providing several notches for the detent.

It will be obvious to those skilled in the art that many modifications may be made within the scope of the present invention without departing from the spirit thereof, and the invention all such modifications.

What I claim is:

1. In a device for forming a leno selvage on fabrics made on shuttleless weaving machines, comprising a rail-like leno body mounted to upper and lower heddle slide bars and acting as a support means for pairwise arranged needles pointing toward each other and with eyelets for pairwise provided standard threads, further comprising a control means displaceable parallel to the needles and provided with control apertures for pairwise provided leno yarns, the improvement which comprises fastener means at the upper rail end of the leno body fixing the position of the device on an upper heddle slide bar, and quick-fit fastener means securing the remaining ends of the device to be fastened to the heddle slide bars, whereby a displacement along the heddle slide bars is permitted.

2. A device according to claim 1 including plug-in connect means with spring clamping parts at the rail-like parts of the device.

3. A device according to claim 1 including quick-fit fastener means enclosing the heddle slide bars in the manner of hooks and acting in a spring-elastic manner in the longitudinal direction of the rail-like body.

4. A device according to claim 3 including means mounting the hook-like means in a longitudinally stepwise adjustable manner on elastic transmission members, for instance rubber cords.

5. A device according to claim 3 or claim 4, in which the hook-like means rest elastically by their ends against the side of the heddle slide bar.

6. A device according to claim 1 including fastener means enclosing the heddle slide bars and cooperating with compression pieces which are adapted to be displaceable in the longitudinal direction of the rail-like body.

7. A device according to claim 6 including means mounting the compression pieces in a spring-elastic manner.

8. A device according to claim 6 including detent means adapted to receive the compression pieces.

* * * * *

UNITED STATES PATENT AND TRADEMARK OFFICE

CERTIFICATE OF CORRECTION

PATENT NO. : 4,445,544

DATED : May 1, 1984

INVENTOR(S) : Valentin Krumm

It is certified that error appears in the above-identified patent and that said Letters Patent is hereby corrected as shown below:

On the title page

Item [30] has been omitted and should read as follows:

- - - Foreign Application Priority Data
Feb. 26, 1981 [DE] Fed. Rep. of Germany .....
3107116 - - -.

Column 3, line 11,"a" has been omitted after "of".

Signed and Sealed this

*Fourteenth* Day of *August 1984*

[SEAL]

*Attest:*

GERALD J. MOSSINGHOFF

*Attesting Officer*

*Commissioner of Patents and Trademarks*